United States Patent [19]

Reinhardt et al.

[11] 4,396,193

[45] Aug. 2, 1983

[54] ROULETTE WHEEL DIRECTIONAL SENSING APPARATUS

[75] Inventors: Richard L. Reinhardt; Billie R. Williams; Michael J. Woodring, all of Reno, Nev.

[73] Assignee: Imagineering, Inc., Reno, Nev.

[21] Appl. No.: 264,258

[22] Filed: May 18, 1981

[51] Int. Cl.[3] ..... A63F 5/00

[52] U.S. Cl. ..... 273/142 B; 273/138 A

[58] Field of Search ..... 273/121 A, 138 A, 143 R, 273/143 C, 142 R, 142 B, 118 A, 119 A, 120 A, 123 A

[56] References Cited

U.S. PATENT DOCUMENTS

| | | | |
|---|---|---|---|
| 2,618,486 | 11/1952 | Durant | 273/121 A |
| 3,909,002 | 9/1975 | Levy . | |
| 3,993,312 | 11/1976 | Burnside | 273/121 A |
| 4,095,795 | 6/1978 | Saxton et al. | 273/143 R |
| 4,099,722 | 7/1978 | Rodesch et al. . | |
| 4,238,127 | 12/1980 | Lucero et al. | 273/138 A |
| 4,299,388 | 11/1981 | Resch | 273/138 A |

FOREIGN PATENT DOCUMENTS

| | | | |
|---|---|---|---|
| 2609169 | 9/1976 | Fed. Rep. of Germany | 273/142 B |
| 2656024 | 6/1978 | Fed. Rep. of Germany | 273/142 B |

*Primary Examiner*—Vance Y. Hum

*Attorney, Agent, or Firm*—Townsend & Townsend

[57] ABSTRACT

A roulette game is modified by electronic circuitry, including a microprocessor, to determine which one of a set of numbered, red or black compartments receives a ball and displays the play results via a lighted, marked roulette table upon which stakes are placed. The invention includes light emitting sensors that are placed beneath the roulette wheel, each compartment of which has an aperture formed therein, to monitor the compartment by detecting light passing through the apertures. Timing marks placed on the wheel are monitored by detector circuitry to determine the direction of rotation and angular rotation of the wheel, relative to a predetermined position. A microprocessor receives the information provided by the sensors and detector circuitry to determine which compartment received the ball, calculates winning wagers, and illuminates the corresponding spaces of the roulette table to inform players of the results.

10 Claims, 7 Drawing Figures

ROULETTE WHEEL DIRECTIONAL SENSING APPARATUS

BACKGROUND OF THE INVENTION

The present invention relates generally to roulette gaming apparatus and more particularly to a system that automatically determines which compartment of a roulette wheel finally receives the roulette ball and displays the results to players via a lighted table upon which the stakes are placed.

Roulette, a popular game of chance, is played against a "banker" using a roulette wheel rotatably held within a structure called a bowl. The roulette wheel carries a plurality of numbered, red and black compartments that are formed on an upward facing surface that borders the periphery of the wheel. The roulette wheel, and bowl in which the wheel is mounted, sits on a table portion of the upper surface of which is typically marked to delineate spaces that are colored and numbered to correspond with the compartments of the wheel.

Wagers are made by the players by placing the stakes upon the marked spaces of the roulette table. Each game is initiated when, after the wagers are placed, the croupier (i.e., the person in charge of operating the game on behalf of the banker) spins the roulette wheel and sets a ball in motion in a race formed in the bowl in an opposite direction from the wheel's spin. Ultimately, the ball will drop into one of the compartments, defining the winning wagers by the number associated with the ball-receiving compartment, whether the number is odd or even, the color of the compartment, and like combinations of compartment indicia.

The game of roulette has been played in this manner, using essentially the same equipment as described, for centuries. The game, as described, is not without certain problems, however. For example, some unscrupulous players, in an effort to tip the odds in their favor, will surreptitiously place a small sponge or other material in one or more of the compartments of the roulette wheel in order to obviate the chance that the ball will be received by the altered compartment or compartments. Placement of the material in any compartment is easily accomplished by skilled persons without the croupier's knowledge, when his attention is, for example, focused upon paying off the winning wagers; and some of the materials used are so ingenious that they cannot be discovered without a thorough inspection of the wheel.

Another form of advantage taken by perfidious players, usually referred to as "post-play betting," again relies upon the croupier's focus of attention upon the wheel during the crucial moments of game play. In order to determine which compartment of the roulette wheel the ball drops into, and at the instant the ball finally comes to rest, the croupier's attention is on the wheel. At this moment in time a player will quickly switch his wager by moving the stake from one table space to a winning space.

Yet another problem encountered is croupier error. When the ball finally falls into a compartment, the croupier must quickly calculate all winning combinations and determine winning wagers such as, for example, the number and color of the compartment, whether the winning number is odd, even, in the first, second or third set of all available compartments numbers, etc. In short, there are times when a croupier erroneously pays on a non-winning wager.

Thus, there is needed apparatus which can detect which compartment of the roulette wheel the ball finally decides to drop into, allowing the croupier to focus his attention on the betting surface of the table. The apparatus should provide the croupier with indicia of the compartment in which the ball rests which requiring the croupier's eyes to leave the betting surface. Finally, the apparatus should also be able to detect foreign matter placed in any of the compartments.

SUMMARY OF THE INVENTION

The present invention provides electronic apparatus that quickly and decisively determines which one of a set of compartments of a roulette wheel finally receives a roulette ball, calculates the winning combinations, and provides indicia of the winning number by illuminating selected spaces of a betting surface of a roulette table. The invention is inexpensive to manufacture, easy to use, and, as will be seen, obviates post play betting and is capable of detecting foreign matter placed in the compartments.

According to the present invention, a roulette table is modified in the following manner: The betting surface of the table is fabricated to include a translucent material that is marked to delineate a number of spaces. The spaces are provided with indicia indicating a particular correspondence between each space and one or more of the compartments of the roulette wheel. Mounted beneath the translucent material is an array of illuminants, one for each of the spaces. The roulette wheel is modified so that each compartment has an aperture formed in the bottom thereof to allow light to pass therethrough. Situated beneath the wheel, and at a locations so as to detect the light passed by the apertures, are optical sensors that determine which compartments are empty and which contain a ball or other material by noting the absence of light transmission by an aperture. The wheel is provided with reflective timing marks that are read by reflective object detectors to provide information respecting the relative position of the wheel and the direction of rotation at any moment in time. The information obtained by the sensors and detectors is collected by a microprocessor which determines the winning compartment (i.e., the compartment that finally receives the roulette ball) and computes the winning combinations. The results are communicated to a display mechanism that causes activation of those illuminants associated with the spaces of the translucent betting surface corresponding to the computed winning combinations denoting the winning wagers.

In the preferred embodiment, four light sensitive or optical sensors, spaced 90° apart from one another, are mounted beneath the roulette wheel to read the light passed through the compartment apertures. A timing disc, carrying reflective markings, is placed on the underside of the wheel and read by a reflective object detector that is a combination light-emitting/light-sensing device to provide signals containing information that identifies each compartment and its location, i.e., information that is indicative of which compartment is being ready by an optical sensor by any moment of time.

As the wheel is rotated, each of the apertures is moved into and out of a position with each optical sensor that allows the sensor to receive any light passed therethrough. At the same time, the object detectors read the reflective timing marks to obtain information that can be used to determine which compartment is positioned over which optical sensor at any moment in time. If any compartment is not empty, the aperture formed therein will be obstructed and its failure to pass light therethrough will be sensed by one of the optical sensors. The microprocessor determines how many and which of the compartment apertures do not pass light by monitoring the signals produced by the optical sensors and reflective object detectors. If more than one compartment aperture is found to be obstructed, an error condition is indicated via appropriate illumination of the betting surface. If only one compartment aperture is indicated as being obstructed, the microprocessor will so indicate via the illuminated betting surface.

It will be readily evident that a number of advantages are obtained by the present invention. First, the apparatus of the present invention is capable of performing the dual function of determining which compartment receives the roulette ball each game play period and of providing indicia of that determination at the wagering surface of the table. Thereby, the croupier is relieved of the responsibility of keeping his eyes on the wheel to determine which compartment receives the roulette ball. Rather, the croupier can focus his attention upon the wagering surface to protect against post-play betting—or any other possible mischief.

In addition, the invention is also capable of determining the presence of any material that obstructs the passage of light through the aperture formed in the compartment. Accordingly, the invention is capable of protecting against attempts to keep the ball from dropping into certain pockets, again freeing the croupier to concentrate on the wagering surface.

These and other advantages and aspects of the present invention will become apparent from a reading of the following detailed description which should be taken in conjunction with the accompanying drawings.

DETAILED DESCRIPTION OF THE PREFERRED EMBODIMENT

Figure 1:
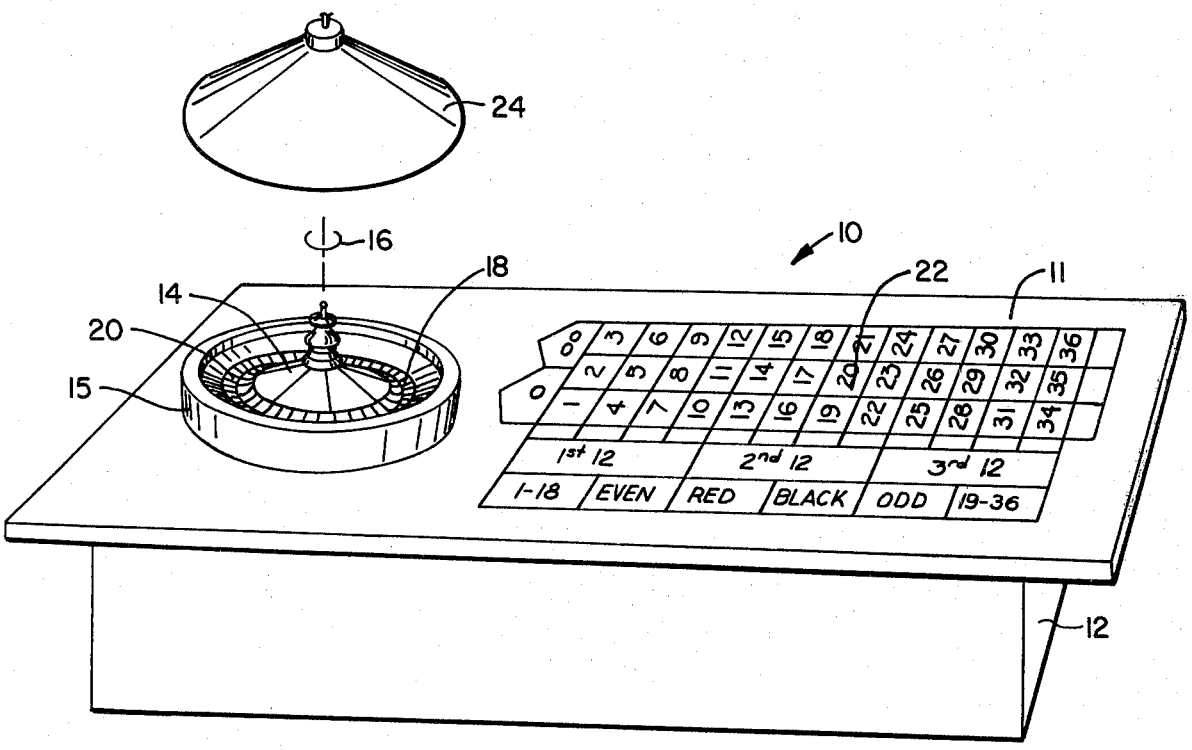
FIG. 1 is a perspective view of a roulette table incorporating the present invention.

Illustrated in FIG. 1 is a roulette table, designated generally with the reference numeral 10, shown as including a table top 11 carried by or otherwise mounted to a base structure 12. Set upon the upper surface of the roulette table 10 is a roulette wheel 14 that is mounted in a bowl 15 for rotation about a vertical axis 16. The roulette wheel 14, being of conventional design, is provided with a set of thirty-eight (38) separately numbered and colored compartments 18 on the upward-facing surface of the roulette wheel 14 and about its periphery 20.

Adjacent the roulette wheel 14 is a wagering surface 22 formed from a translucent material such as, for example, plexiglas, marked to delineate spaces that correspond to the numbered and colored compartments 18 of the roulette wheel 14. Situated directly above the roulette wheel 14, and oriented to radiate downward toward the wheel, is a source of light 24.

Figure 2:
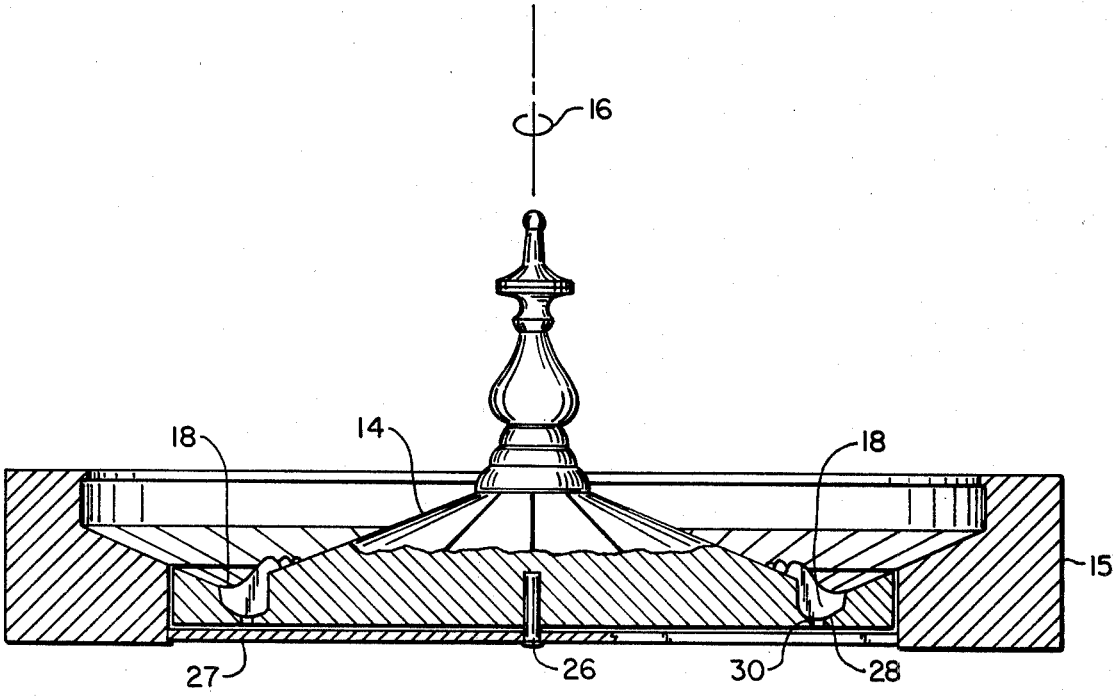
FIG. 2 is a side plan view, partly in section, of the roulette wheel shown in FIG. 1.

The roulette wheel 14 itself, illustrated in greater detail in FIG. 2, is mounted in the bowl 15 via a spindle 26 about which the roulette wheel 14 rotates. The spindle 26 is attached to the bowl by a plate 27 that is, in turn, affixed to the bottom of the bowl 15. The roulette wheel 14 has been modified in the following manner in order to incorporate the present invention: Each of the ball-receiving compartments 18 have formed in the bottom portion 28 thereof an aperture 30. Mounted beneath the roulette wheel 14 are four light sensitive or optical sensors 01, 02, 03, and 04 (illustrated in phantom in FIG. 3), positioned to allow the apertures 30 to be moved into and out of overlying relationship with each optical sensor when the roulette wheel 14 is rotated. As FIG. 3 further indicates, the optical sensors 01–04 are arranged in a generally circular pattern at 90° intervals from one another.

Figure 3:
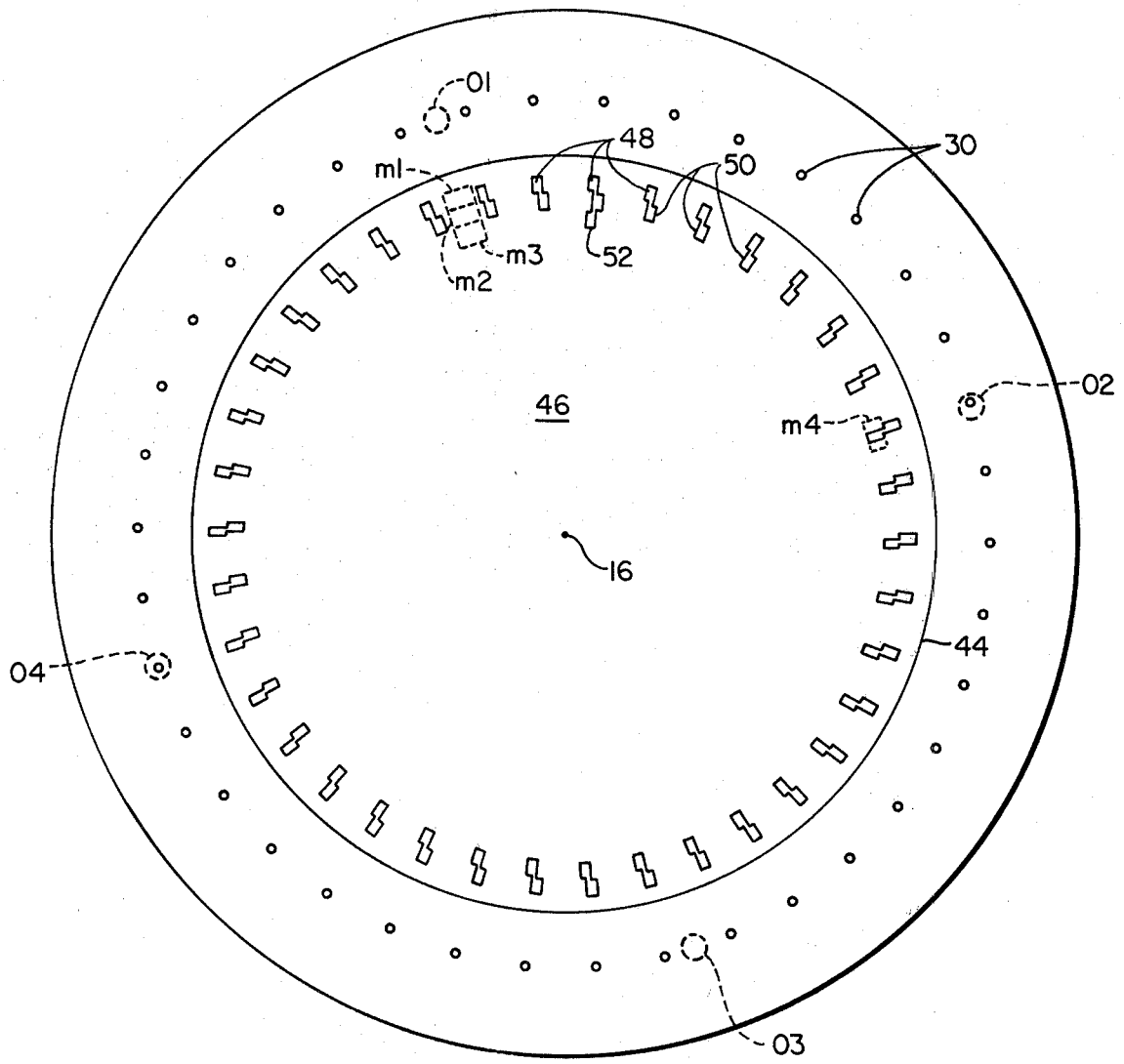
FIG. 3 is a bottom plan view of a roulette wheel modified for use in the present invention and illustrating placement of the optical sensors and detectors by superimposing phantom illustrations of these elements onto the bottom plan view of the roulette wheel.

Mounted to the underside of the roulette wheel 14 is a circular timing disc 44 (FIG. 3). The timing disc 44 includes a darkened surface 46 that carries two sets of reflective timing marks 48, and 50 and a sync mark 52. The two sets of timing marks 48 and 50 are arranged in an equally spaced circular fashion on the timing disk 44, and each individual timing mark of each set corresponds to one of the numbered compartments 18 of the roulette wheel 14. Each of the timing marks 48 are set on radials that are 9.47° apart from adjacent timing marks (360°/38, where 38 is the number of compartments). The timing marks 50 are similarly situated but offset from the set comprising timing marks 48 as illustrated in FIG. 3.

Mounted beneath the roulette wheel 14, and in underlying relation with the timing disk 44, are four reflective object detectors M1, M2, M3, and M4 (also illustrated in phantom in FIG. 3). The reflective object detectors are of the type that include in a single housing a reflective object sensor comprising an infrared emitting diode and an infrared sensitive transistor. Such reflective object sensor devices are commercially available from General Instrument Corporation of Palo Alto, Calif., sold under the part No. MCA7, and described at pages 61–64 in the publication entitled "General Instruments Opto-Electronics, 1980." The reflective object detectors are mounted beneath the roulette wheel 14, proximate the timing disc 44, and oriented so that the infrared light generated by the diode of each detector will be reflected by the corresponding timing marks 48, 50 or 52 carried by the timing disc 44.

The four reflective object detectors M1–M4 are mounted in the configuration shown in FIG. 3. Three of the reflective object detectors, detectors M1, M2, and M3, are set on a line that passes through the axis 16 (illustrated as a point in FIG. 3) of the roulette wheel 14 and the optical sensors 01 and 03. The detector M1 is situated, relative to the timing disc 44, to read the timing marks 48; detector M2 is situated to read the timing marks 50; and the detector M3 is situated to read the sync timing mark 52. The detector M4 is positioned on a line that passes through the axis 16 and optical sensors 02 and 04. Detector M4 is located to read the timing marks 48.

Figure 4A:
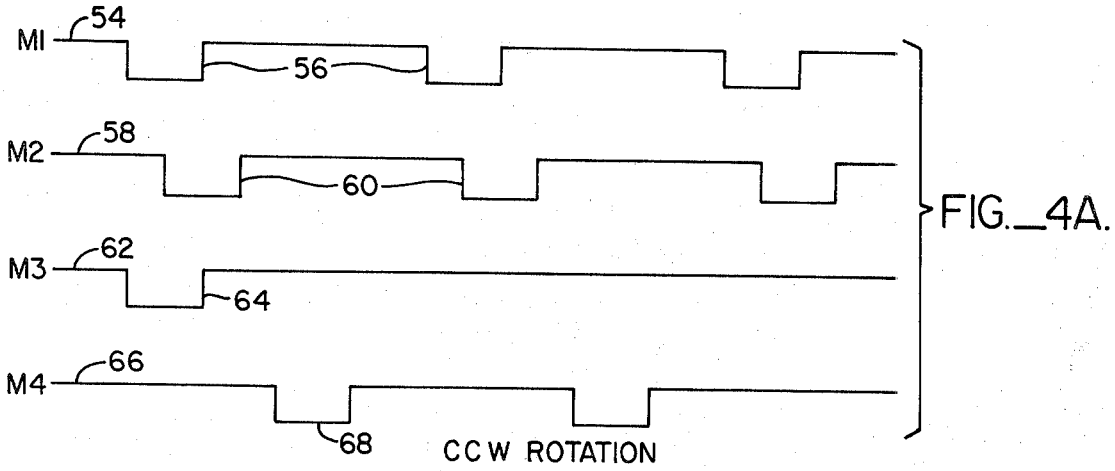
FIGS. 4A and 4B are timing diagrams illustrating the electrical signals, and their relative relation, produced by the optical sensors and reflective object detectors of the invention.
Figure 4B:
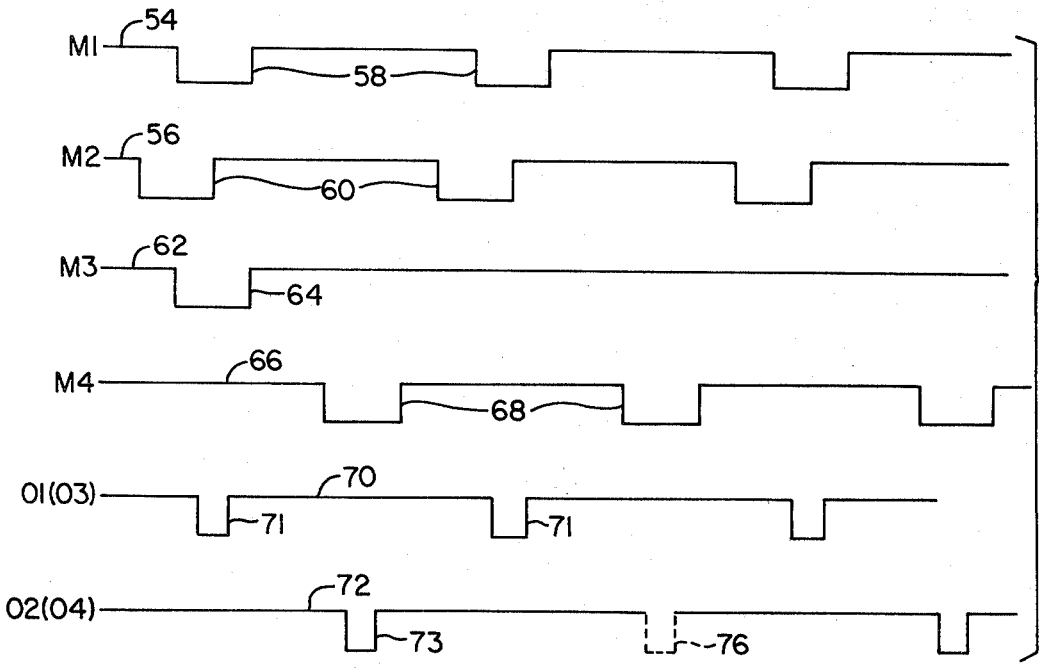

The detectors M1 and M4, in conjunction with the timing marks 48, are used to produce timing signals that form "windows" to indicate when a corresponding compartment aperture 30 is in a position that overlies one of the optical sensors 01–04. The signal generated by the detector M2, on the other hand, is used to determine the direction of rotation or spin of the roulette wheel 14. This can be seen from the timing diagrams of FIGS. 4A and 4B. During rotation of the roulette wheel 14 (and, of course, the timing disc 44 attached thereto) the signal produced by the detectors M1–M4 will change from a binary ONE to a binary ZERO to form negative going pulses that indicate detection of a timing mark 48, 50 or 52. Thus, in FIGS. 4A and 4B, the timing marks 48 produce via the detector sensor M1 the pulse train 54, having negative going pulses 56. Similarly, the timing marks 50 are indicated by the signal produced by the detector M2 in the form of the pulse train 58 having negative going pulses 60; the sync mark 52 will cause detector M3 to generate the signal 62, containing the one pulse 64 each revolution of the roulette wheel 14; and detector M4 produces the pulse train 66, having the negative going pulse 68. In order to determine the direction of rotation, the state of the signal 58 is checked immediately after the logic ZERO to ONE transition of the signal 54. If, at this time, the signal 58 is a logic ZERO, as illustrated in FIG. 4A, a counterclockwise rotation of the roulette wheel 14 is indicated. Conversely, if the state of the signal 58 is a logic ONE, a clockwise rotation is indicated (FIG. 4B).

As the roulette wheel 14 rotates, the apertures 30 will be moved into and out of overlying relation with the optical sensors 01–04 that underly the wheel. As mentioned, the optical sensors 01–04 are positioned, relative to the wheel, so that only two sensors (e.g., sensors 01 and 03) at any one time underly a corresponding pair of the apertures 30; the remaining pair of sensors (e.g., sensors 02 and 04) are located 4.74° of wheel rotation from an aperture pair. As the wheel rotates, a pair of apertures 30 are moved into a position that communicate light generated by the light source 24 to a sensor 01/03 or 02/04. This causes the corresponding sensors to change state from a binary ONE to a binary ZERO. Thus, sensor 01 (or 03) will produce the pulse train 70 during rotation of the roulette wheel 14, while sensor 02 (or 04) will produce the pulse train 72 (FIG. 4B).

As noted above, each of the timing marks 48 is aligned with a corresponding compartment 18 so that the state of the signals 54 and 58 (i.e., the pulses 71 and 73) indicates that a pair of compartments 18 overly a sensor pair 01/03 or 02/04. At this time the presence of a pulse from sensors 01/03 or 02/04 indicates that the corresponding apertures 30 is not obstructed and that the associated compartment 18 is empty. Conversely, of course, absence of such a pulse, such as indicated in phantom at 76 in the pulse train 72 (FIG. 4B), indicates that the corresponding aperture 30 is blocked and that the associated compartment 18 contains a roulette ball or other matter.

The sync mark 52 is used to define the beginning of a wheel rotation. It is arbitrarily made coincident with the compartment 18 having the "double zero" (i.e., 00) designation. The remaining compartments are defined by the windows (i.e., pulses 56 and 68) generated by detectors M1 and M4. As will be discussed below, all the information necessary to determine which compartment 18 is not empty can be obtained from the pulse trains 54, 58, 62 and 66, regardless of the direction of rotation of the roulette wheel 14.

Figure 5:
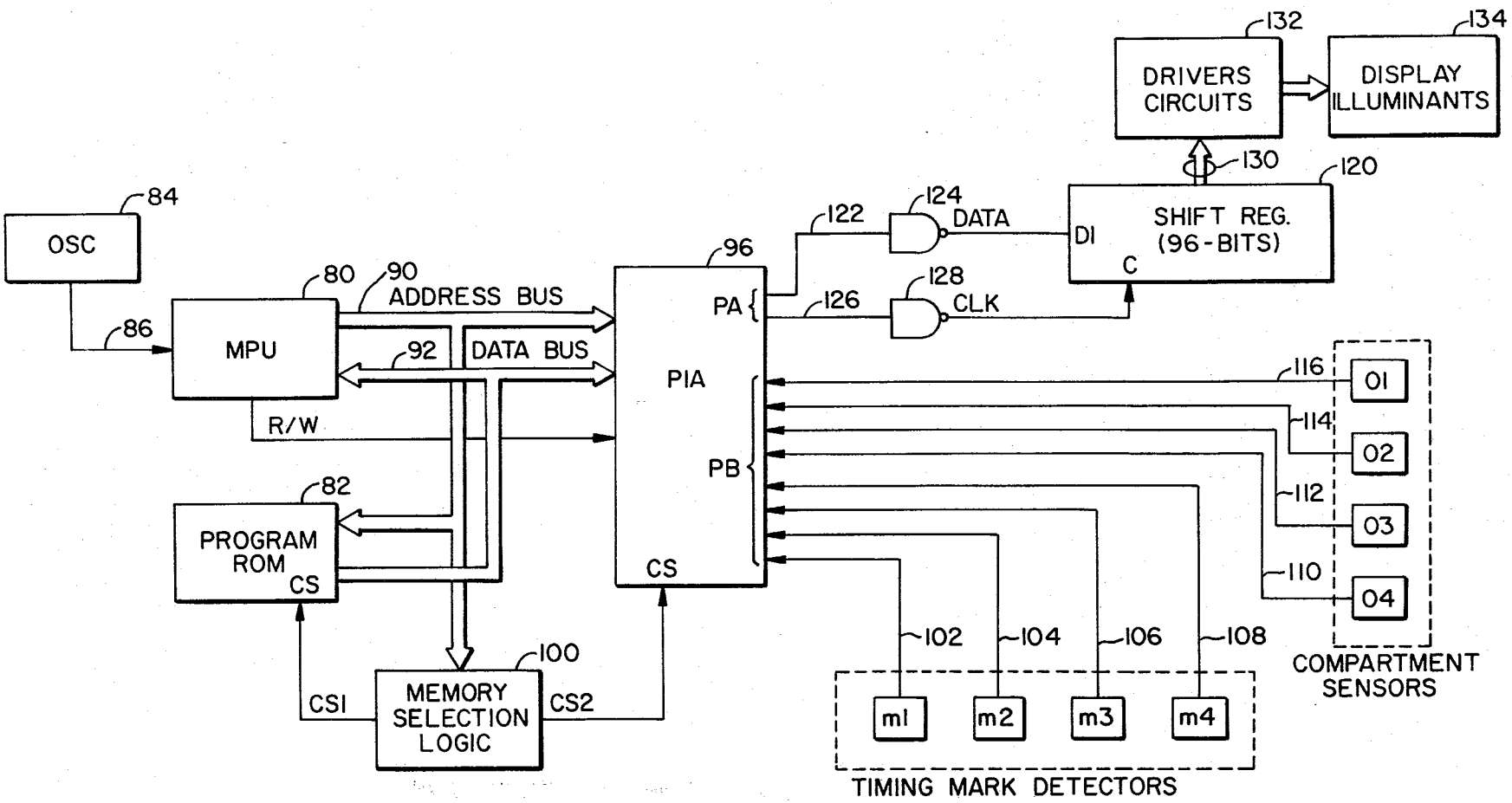
FIG. 5 is a block diagram schematic of the electronics of the present invention.

FIG. 5 contains the block diagram of the circuit used to receive the information provided by the optical sensors 01–04 and detectors M1–M4 and to calculate the winning combinations upon detection of the presence of the ball in one of the compartments 18. As illustrated, the circuit includes a microprocessor unit (MPU) 80 that operates in response to a sequence of instructions obtained from a program read-only-memory (ROM) 82. An oscillator circuit 84 provides a clock signal that is conducted to the MPU 80 via signal line 86.

The MPU 100 is connected to the program ROM 82 by an address bus 90 and a data bus 92. The address bus 90 communicates multi-bit addresses to the address circuits (not shown) of the program ROM to select specific memory locations, the contents of which are issued from the program ROM 82 via the multi-bit data bus 92.

The address and data buses 90, 92 also couple the MPU 80 to a peripheral interface adapter (PIA) 96. PIA 96 is of conventional design, normally sold under the generic part number 8155 by a number of integrated circuit manufacturers such as, for example, Intel Corporation of Santa Clara, Calif. The PIA 96 is structured to function as an input/output device that acts as an interface between the MPU 80 and other elements of the system such as, for example, the detectors M1–M4 and the optical sensors 01–04. The PIA 96 has two 8-bit input/output (I/O) ports PA and PB which can be "programmed" by the MPU 80 to act either as an input or an output port. In the present invention, the I/O port PA is programmed as an output port, and the I/O port PB is programmed to function as an input port.

The PIA 96 also contains a limited amount of random-access-memory (RAM) (not shown). In order to distinguish between the ROM contained within the PIA 96 and the program ROM 82, a memory selection logic 100 is provided to which the address bus 90 is coupled. The memory selection logic 100 functions to generate one of two chip select signals, CS1 or CS2 that are respectively conducted to the chip select (CS) inputs of the program ROM 82 and PIA 96. Depending upon which memory (i.e., program ROM 82 or the RAM of PIA 96) is being accessed, the memory selection logic 100 will decode the address signals conducted on the address bus 90 and issue the appropriate chip select signal to cause the accessed data to be applied to the data bus 92, and inhibiting data from the non-selected memory.

The timing mark detectors M1, M2, M3, and M4 are individually coupled to four of the eight available input bits of the input port PB via signal lines 102, 104, 106, and 108, respectively. Similarly, each of the optical sensors 01, 02, 03, and 04 are conducted to the remaining four input bits of the input port PB via signal lines 110, 112, 114, and 116.

Only two of the 8 available bits of the output port PA are used to communicate data in a serial bit stream to a 96 serial-in-parallel-out shift register 120, accompanied by a clock (CLK) signal. The series data is conducted via a signal line 122 and driver gate 124 to the data input (DI) of the shift register 120. The accompanying CLK signal is conducted on the signal line 126, via driver gate 128, to the clock (C) input of the shift register 120 and used to clock the data that is applied to the DI input of the shift register.

Output lines 130 apply the contents of the shift register 120 to driver circuits 132 which, in turn, drive the display illuminants 134. Although not specifically shown, there exists an illuminant for each of the delineated spaces on the wagering surface 22 (FIG. 1). Correspondingly, for each illuminant there is assigned one of the individual stages (not shown) of the shift register 120. A logic ONE contained in this stage will cause activation of its corresponding illuminant; and, a logic ZERO will hold the illuminant in a deactivated state.

Figure 6:
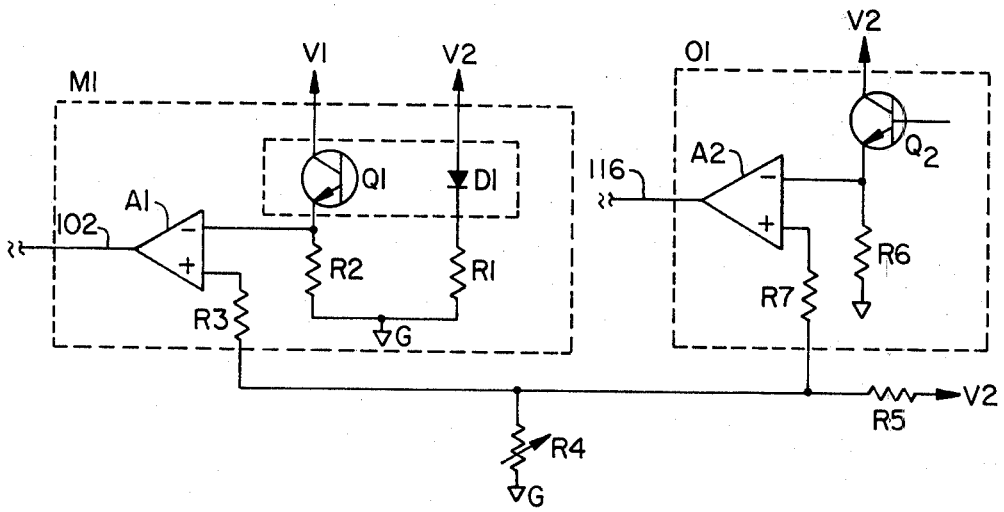
FIG. 6 is a schematic of the optical sensor and reflective object detector circuits used in conjunction with the invention shown in FIG. 5.

The signals that are conducted to the input port PB of the PIA 96 via the signal lines 102–116 are binary signals compatible with the PIA 96 that assume either the logic ONE or ZERO states illustrated in FIGS. 4A and 4B. Illustrated in FIG. 6 are the circuit components that make up the detector M1 and optical sensor 01 to produce these binary signals. Circuit construction of the detectors M2, M3 and M4 is substantially identical to that illustrated for detector M1; and the circuit construction of optical sensors 02, 03 and 04 is substantially identical to that shown for 01 in FIG. 6. Accordingly, only the circuit construction of detector M1 and optical sensor 01 will be illustrated and explained, it being understood that the description can be equally applied to the detectors M2–M4 and optical sensors 02–04, as the case may be.

As illustrated in FIG. 6, the reflective object detector M1 includes as infrared emitting diode D1 and an infrared responsive transistor Q1. The anode of the diode D1 is connected to a positive voltage V2 (typically +5 volts DC) and the cathode is connected to ground G via a resistor R1. Similarly, the collector lead of the transistor Q1 is connected to a positive voltage V1 (typically +12 volts DC) and the emitter lead is tied to ground G via a resistor R2. The emitter lead of the transistor Q1 is also connected to the negative (−) input of a high gain differential amplifier A1, the output of which is connected to the signal line 102 that conducts the signal produced by amplifier A1 to one of the input bits of the I/O input port PB (FIG. 5). The positive (+) input of the amplifier A1 is connected to ground G via a resistor R3 and a variable resistor R4; and it is also tied to the voltage V2 via resistors R3 and R5. The resistive-network comprising resistors R3, R4 and R5 sets the level at which the amplifier A1 will switch its output state from a binary ONE to a binary ZERO, or vice versa, in response to the signal from the transistor Q1, indicating that a timing mark is in the field of view of the detector.

The circuit construction of the optical sensor 01 is shown as including light sensitive transistor Q2 whose emitter lead is tied to he voltage V2 and whose emitter lead is tied to ground G via a voltage developing resistor R6, as well as being connected to the negative (−) input of the amplifier A2. The positive (+) input of the amplifier A2 is connected to ground G via the series resistance network comprising resistor R7 and variable resistor R4. In addition, a level setting voltage is applied to the positive (+) input of the amplifier A2 via the series resistance established by resistors R7 and R5, the latter being connected to the voltage V2. Although not specifically shown, the outputs of both amplifiers A1 and A2 are connected to the voltage V2 through appropriate resistance networks to limit the upper voltage range of the output signals produced to that used by the digital circuitry for a logic ONE (i.e., typically +5 volts).

The detector M1 (and detectors M2, M3 and M4) operates as follows: The diode D1 emits a low level infrared light beam. The diode, and its associated transistor Q1, are oriented relative to the timing disc so that the timing marks 48 will be moved into and out of the beam of the timing marks 48 will be moved into and out of the beam of infrared light generated by the diode D1. Since the timing marks 48 are reflective, the infrared light beam will be reflected back and detected by the transistor Q1 causing the transistor to conduct. Conduction of the transistor Q1 causes the voltage applied to the negative (−) input of the amplifier A1 to rise above that applied to the positive (+) input, in turn causing the amplifier A1 to produce and apply a logic ZERO to the signal line 102. When no infrared light beam is reflected, the transistor Q1 is in a non-conducting state, applying essentially a ground voltage to the negative (−) input of the amplifier A1, and causing the output of the amplifier to assume a logic ONE state. Thereby, the pulse train signal 54 having the negative going pulses 56 are produced by the detector M1 when the roulette wheel 14 is rotated.

The optical sensor 01 operates in a somewhat similar manner (as do optical sensors 02, 03 and 04). The light sensitive transistor Q2 of optical sensor 01 is positioned, as mentioned above, beneath the roulette wheel 14. The transistor Q2 is located to allow, when the roulette wheel is rotated, each of the apertures 30 formed in the compartment 18 to be sequentially positioned to pass light produced by the light source 24 to the transistor Q2. When a sufficient amount of light is radiated upon the transistor Q2 it will conduct, bringing the voltage level applied to the negative (−) input of the amplifier A2 to a level higher than that before conduction and greater than that applied to the positive (+) input. This causes the output produced by the amplifier A2 to switch from a logic ONE to a logic ZERO state. When an aperture 30 is moved away from an overlying position relative to transistor Q2, the light received by the transistor is diminished and condition of the transistor Q2 is concomitantly reduced. The voltage level applied to the negative (−) input of the amplifier A2 is also reduced to a level below that applied to the positive (+) input, causing the output of the amplifier A2 to switch back to a logic ONE. Thereby, the pulse train signal 70, illustrated in FIG. 4B, is produced.

A roulette game constructed to incorporate teachings of the present invention operates as follows: The roulette wheel 14 is spun in one direction while the roulette ball is spun along the race (not specifically shown) of the bowl 15 in an opposite direction. The MPU 80 (FIG. 5) begins reading the input port PB of the PIA 96, looking for the sync pulse 64 produced by the timing mark detector M3. When the sync timing mark is moved into view of detector M3, a logic ZERO is produced on the signal line 106 and ready by the MPU 80. The MPU 80 then checks spin direction by observing the state of the signal produced by detector M2 immediately after a transition from a logic ZERO to a logic ONE of the output of detector M3. If, at this time, the output of the detector M2 is a logic ZERO, the rotation is determined to be counterclockwise (see FIG. 4A). Conversely, if the timing mark detector M2 output is a logic ONE at this time, the rotation is clockwise (FIG. 4B).

Having determined spin direction and the location of the sync timing mark 52 (which is identical to the double zero compartment) the MPU 80 commences to continually observe the signals generated by the detectors M1–M4, via the input port PB, counting the pulses generated by the signal produced by the detector M1 to maintain a count from which can be determined which compartment overlies which optical sensor at any moment in time. When a logic ZERO is generated by the timing mark detector M1 or M2 the corresponding pair of compartment sensors 01/03 or 02/04, respectively, are sampled to determine the presence or absence of a signal which, in turn, indicates whether the corresponding compartment aperture is obstructed.

Since the optical sensors 01–04 are positioned at approximately 90° intervals relative to each other, the roulette wheel 14 can be read four times per rotation. If an obstruction is sensed in any one read cycle (one-quarter wheel rotation), an immediately succeeding read cycle is executed and the results compared. If the results are identical, the winning bets are computed and the computation used to form a multi-bit data word, each bit corresponding to an individual bet, and the data word serially transmitted, with a clock signal, from the output port PA of the PIA 96 to the shift register 120. After transmission, those bit locations of the shift register 120 containing logic ONEs will cause, via the driver circuits 132, activation of the corresponding illuminants of the display 134. On the theory that "money touching light wins," the winning bets are easily determined by merely observing which of the spaces 22 are illuminated.

If two immediately succeeding read cycles, after comparison, are found to have results that are not identical (for example, in the case of a bouncing ball) additional read cycles are executed until:

(a) no obstruction is sensed in four read cycles;

(b) more than one obstruction is sensed in a read cycle; or (c) a match is obtained in two consecutive read cycles.

In situation (a), the MPU 80 formulates a multi-bit word containing all logic ZEROs and transmits that word to the shift register 120, clearing the display 134.

In situation (b), the MPU 80 repeatedly formulates multi-bit data words that are transmitted to the shift register 120 to cause the display to be flashed in sequence, indicating an error condition.

Finally, when situation (c) is encountered, the winning bets are computed and transmitted to the shift register to cause the display to provide the appropriate indicia by activating the appropriate illuminants that indicate the winning wagers.

While the above provides a full and complete disclosure of the preferred embodiment of the invention, various modifications, alternate constructions and equivalents may be employed without departing from the true spirit and scope of the invention. Therefore, the above description and illustrations should not be construed as limiting the scope of the invention, which is defined by the appended claims.

I claim:

1. In a roulette game of the type including a rotatably mounted wheel carrying a plurality of ball receiving compartments, each of said compartments having an aperture formed therein for passing light therethrough, apparatus for determining which one of said compartments receives a game ball and for displaying said determination, said apparatus comprising:

sensor means mounted relative to said wheel so that said apertures are sequentially moved into proximate relation therewith when said wheel is rotated, for producing a first signal in response to sensing light passed through each of the apertures, the sensor means including means for generating a second signal identifying each one of said compartments and means for determining a direction of rotation of said wheel;

processor means coupled to said sensor means and responsive to said first and second signals and to the rotation determining means for determining therefrom which one of said compartments receives the game ball and for computing winning combinations in the form of a multi-bit data word;

display means coupled to said processor means for receiving said data word and in response thereto for providing visual indicia of said winning combinations.

2. The apparatus of claim 1, wherein a light emitting source is situated generally vertically above said wheel for radiating said wheel with light; the sensor means including at least one light sensitive detector for receiving light passed through said compartment apertures.

3. The apparatus of claim 1, including a plurality of timing marks affixed to said wheel; and said second signal generating means including detector means responsive to said timing marks for generating said second signal identifying said compartments.

4. The apparatus of claim 3, the timing marks being light reflective, said detector means including light emitting means and light responsive means.

5. The apparatus of claim 4, the light emitting means including means for generating infrared light, the light responsive means being responsive to infrared light.

6. The apparatus of claim 1, said sensor means including a disc element mounted to said wheel coaxial with an axis of wheel rotation, said disc carrying a plurality of light reflective marks identifying each of said compartments; emitting means for generating a light that is reflected by said timing marks; and light respective means positioned to receive the reflected light generated by the emitting means to produce said second signal.

7. The apparatus of claim 1, the sensor means including a plurality of timing marks mounted to said wheel, said timing marks including a sync mark corresponding to a predetermined one of said compartments, and a number of second marks each corresponding to a one of said compartments.

8. The apparatus of claim 7, the processor unit including means responsive to the sensor means for counting the markers.

9. The apparatus of claim 1, the display means including a substantially planar translucent member having one surface marked to delineate a plurality of wagering spaces, each of the wagering spaces and a plurality of illuminates, one for each one of the wagering spaces, mounted with the translucent member interposed between the illuminants and said one surface, each illuminant positioned proximate a corresponding wagering space, whereby winning combinations computed by said processor means are indicated by activating certain ones of said illuminants and deactivating remaining ones of the illuminants.

10. The apparatus of claim 1, the rotation determining means including a pair of timing marks, corresponding to each one of the compartments, mounted to the wheel, the timing marks of each pair being relatively arranged in a predetermined relation, and detector means mounted to sequentially detect each pair of timing marks when the wheel is rotated to produce a third signal in response thereto indicative of the direction of wheel rotation.

* * * * *